United States Patent [19]

Poff, Jr.

[11] Patent Number: 4,930,238

[45] Date of Patent: Jun. 5, 1990

[54] RIMFIRE FIREARM RECEIVER

[76] Inventor: Charles R. Poff, Jr., 811 S. Coulter, Bryan, Tex. 77801

[21] Appl. No.: 184,347

[22] Filed: Apr. 21, 1988

[51] Int. Cl.[5] ..... F41C 11/00

[52] U.S. Cl. ..... 42/16; 42/25

[58] Field of Search ..... 42/16, 25; 89/26

[56] References Cited

U.S. PATENT DOCUMENTS

| | | |
|---|---|---|
| 557,079 | 3/1896 | Mondragon . |
| 1,124,071 | 1/1915 | Stamm . |
| 1,352,412 | 9/1920 | Payne . |
| 2,129,875 | 9/1938 | Rost . |
| 2,147,185 | 2/1939 | Ahern . |
| 2,409,569 | 10/1946 | Johnson, Jr. . |
| 2,603,019 | 7/1952 | Elkas . |
| 2,717,535 | 9/1955 | Taylor . |
| 2,811,902 | 11/1957 | Dixon . |
| 2,941,449 | 6/1960 | Reed . |
| 3,027,672 | 4/1962 | Sullivan . |
| 3,253,362 | 5/1966 | Gitchell . |
| 3,613,500 | 10/1971 | Warin . |
| 3,848,351 | 11/1974 | Clark . |
| 4,272,902 | 6/1981 | Waters . |
| 4,555,860 | 12/1985 | Zedrosser . |
| 4,653,210 | 3/1987 | Poff, Jr. . |

FOREIGN PATENT DOCUMENTS 759051 11/1944 Fed. Rep. of Germany .

*Primary Examiner*—Charles T. Jordan
*Assistant Examiner*—Richard W. Wendtland
*Attorney, Agent, or Firm*—Neal J. Mosely

[57] ABSTRACT

A receiver assembly for a firearm slidably and rotatably carries a bolt having a non-rotating cartridge extractor-guide at the forward end which allows the bolt to rotate relative thereto and the bolt head has locking lugs which engage a locking surface in the forward or barrel end of the receiver when the bolt is in the firing position. A flexible feeding ramp in the firing chamber surrounds the extractor and serves as a cartridge guide and pre-loads the bolt axially in the firing position. A firing pin carrier assembly provides axial center line absorption of the firing mechanism forces while providing an off center firing pin tip required for rimfire ammunition. During the initial firing sequence the feeding ramp absorbs vibrations caused by the moving components of the firing mechanisms and the impact of the firing pin and the subsequent shock of ignition, and bullet movement. During the latter stages of the firing sequence the firing pin carrier assembly absorbs the shock of the firing pin cocking rod and sear assemblies thus reducing after shock vibration and contributing to firearm accuracy.

31 Claims, 3 Drawing Sheets

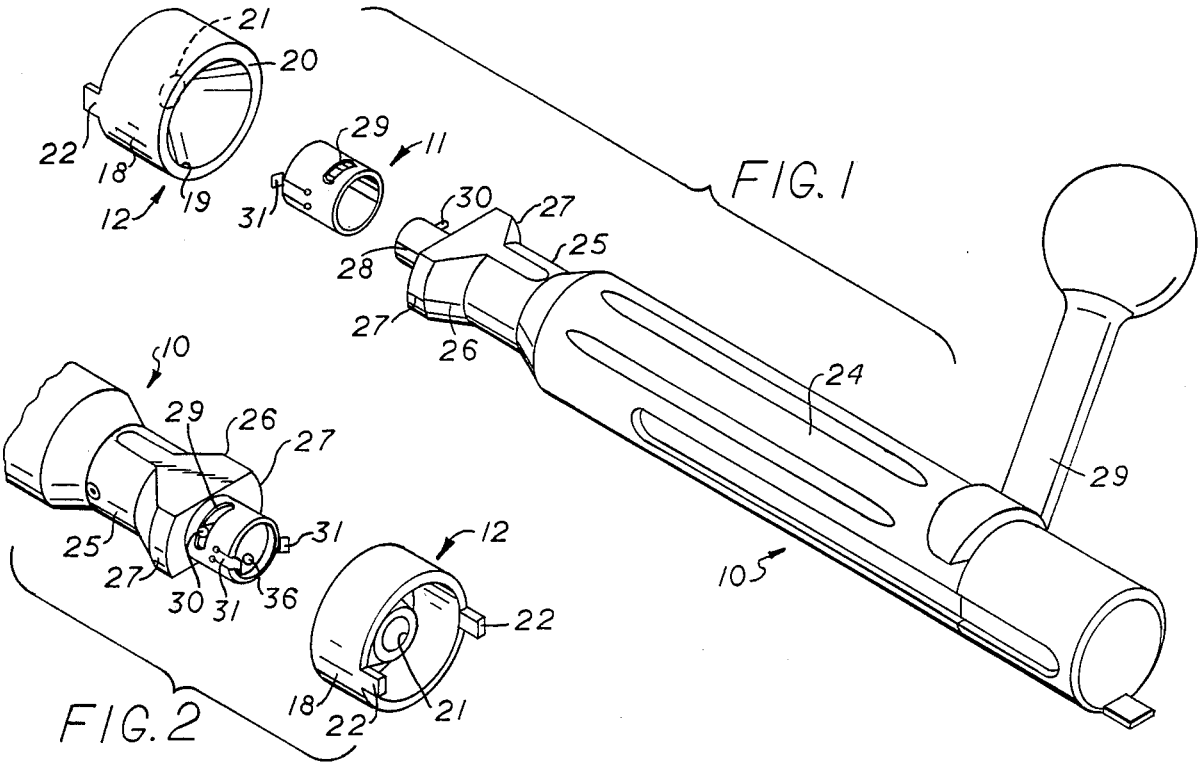
FIG. 1
FIG. 2
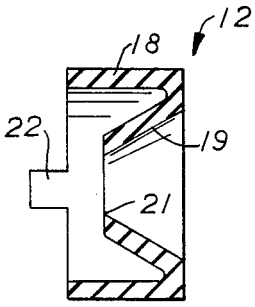
FIG. 3
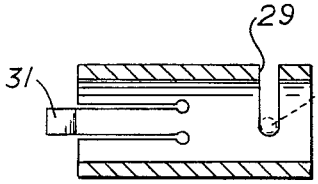
FIG. 5
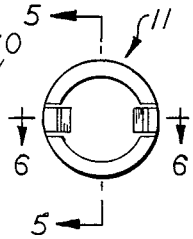
FIG. 4
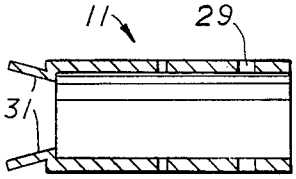
FIG. 6
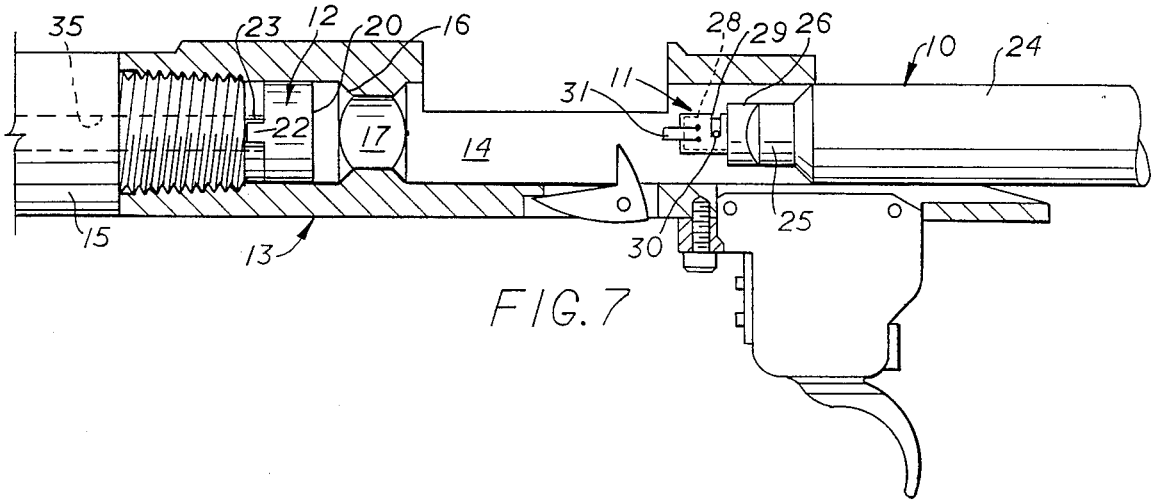
FIG. 7

RIMFIRE FIREARM RECEIVER

BACKGROUND OF THE INVENTION

1. Field Of The Invention

This inventioon relates to rimfire firearms and more particularly to a rimfire firearm receiver with a bolt action having a flexible feeding ramp in the receiver, a non-rotating cartridge extractor-guide, and an axially aligned firing pin carrier assembly having an off center firing pin.

2. Brief Description Of The Prior Art

Firearm bolt actions are known in the prior art and typically comprise a receiver defining an elongated chamber and a bolt slidably received within the chamber. The bolt has one or more lugs radially extending therefrom adjacent one end which slidably engage one or more elongated locking lug grooves formed in the receiver. This allows the bolt to slide with respect to the receiver between an open position, wherein a cartridge may be inserted into the receiver, and a closed position wherein the bolt forces the cartridge into a firing chamber. In order to lock the bolt in the closed position, the receiver also has an annular locking lug recess extending around the periphery of the elongated chamber to accommodate the locking lug when the bolt is in the closed position. This allows the bolt to be rotated through a given angle to move the locking lug out of alignment with the locking lug groove in the receiver.

The locking lugs for locking the bolt in the firing position are customarily made integral with the bolt handle and secured at the rear portion of the bolt. The bolt handle locking lug assembly mounted on the bolt is then oriented in a plane substantially perpendicular to the axis of the bolt and receiver. In locking the bolt relative to the receiver the bolt slides longitudinally so that the locking surfaces on the bolt and receiver are generally in the same plane at which time the bolt is rotated to bring the locking surfaces into engagement. Clearances must be provided to permit the sliding and rotational movement of the bolt with respect to the receiver. The inherent design and manufacturing clearances and tolerances and the extended distance between the front end and rear locking lug assembly of the bolt produce accuracy destroying vibrations when the cartridge is fired.

Due to the relatively low velocity of rimfire cartridges, the vibrations associated with the firing sequence limits the accuracy of the firearm by causing movement of the firearm while the bullet is still moving out of the barrel. Additionally, due to the cartridge being ignited by a blow to the rim the firing pin, its main spring and sear are arranged substantially off the longitudinal center line of the receiver thus adding to the vibration problem by allowing the firing mechanisms total energy to be applied off center to the longitudinal center line of the receiver and barrel.

It is also known in prior art rimfire firearms to provide fixed feeding or loading ramps or guides integral with the receiver and cooperating with the rear of the barrel to insure positive feeding of the cartridge into the chamber. The feeding ramp is generally a fixed assembly mounted in the receiver and conforms to the bottom contour of the non-rotating bolt.

Poff U.S. Pat. No. 4,653,210 discloses a firearm bolt action and extractor.

Sullivan U.S. Pat. No. 3,027,672 discloses a firearm with an aluminum alloy receiver.

Nilsson U.S. Pat. No. 4,547,988 discloses a firearm system with a cylinder bolt mechanism.

Timari U.S. Pat. No. 4,454,672 discloses a lock mechanism for firearm bolt action.

Chambers U.S. Pat. No. 2,139,648 discloses a firearm bolt action and locking mechanism.

Zedrosser U.S. Pat. No. 4,555,860 discloses a rifle breech assembly and shell extractor.

Waters U.S. Pat. No. 4,272,902 discloses a rifle bolt assembly and shell extractor.

Mondragon U.S. Pat. No. 557,079 discloses a breech loading bolt gun.

Stamm U.S. Pat. No. 1,124,071 discloses a straight pull lock for military rifles.

Payne U.S. Pat. No. 1,352,412 discloses a rimfire rifle With shell extractor.

Ahern U.S. Pat. No. 4,555,860 discloses a swing bolt action rifle.

Johnson U.S. Pat. No. 2,409,569 discloses an automatic rifle with reciprocating breech block.

Taylor U.S. Pat. No. 2,717,535 discloses a bolt action rifle and breech assembly.

Dixon U.S. Pat. No. 2,811,902 discloses a bolt action rifle and breech assembly.

Reed U.S. Pat. No. 2,941,449 discloses a decelerating device for a bolt action rifle.

Gitchell U.S. Pat. No. 3,253,362 discloses a bolt action rifle and breech assembly.

Clark U.S. Pat. No. 3,848,351 discloses a bolt action rifle and extractor assembly.

Lehner Austrian patent No. 759051/393 discloses a bolt action rifle and extractor assembly.

The present invention is distinguished over the prior art in general, and these patents in particular by a receiver assembly for a firearm which slidably and rotatably carries a bolt having a non-rotating cartridge extractor-guide at the forward end that allows the bolt to rotate relative thereto and the bolt head has locking lugs which engage a locking surface in the forward or barrel end of the receiver when the bolt is in the firing position. A flexible feeding ramp in the firing chamber surrounds the extractor and serves as a cartridge guide and pre-loads the bolt axially in the firing position. A firing pin carrier assembly provides axial center line absorption of the firing mechanism forces while providing an off center firing pin tip required for rimfire ammunition. During the initial firing sequence the feeding ramp absorbs vibrations caused by the moving components of the firing mechanisms and the impact of the firing pin and the subsequent shock of ignition, and bullet movement. During the latter stages of the firing sequence the firing pin carrier assembly absorbs the shock of the firing pin cocking rod and sear assemblies thus reducing after shock vibration and contributing to firearm accuracy.

SUMMARY OF THE INVENTION

It is therefore an object of the present invention to provide a receiver assembly for a firearm having a flexible feeding ramp which absorbs accuracy destroying vibrations associated with the moving of mechanical parts of the firearm and the subsequent movement of the projectile.

It is another object of this invention is to provide a receiver assembly for a firearm wherein a flexible feeding ramp is compressed between the rear face of the barrel and the front face of the bolt when the bolt is in the firing position to pre-load the bolt.

Another object of this invention is to provide a receiver assembly for a firearm having a flexible feeding ramp which supports bolt locking lugs and surrounds the cartridge supporting nose of the bolt.

Another object of this invention is to provide a receiver assembly for a firearm which incorporates a non-rotating cartridge extractor-guide at the front of the bolt which is held stationary relative to the bolt rotation.

Another object of this invention is to provide a receiver assembly for rimfire firearms having a bolt assembly wherein the movable firing mechanism components are located on the longitudinal center line of the receiver and barrel group such that the forces generated by the firing mechanisms are distributed substantially on the longitudinal axis of the receiver, bolt, and barrel.

A further object of this invention is to provide a receiver assembly for rimfire firearms having a one-piece bolt with integral locking lugs whereby the front end of the bolt is rigidly locked in the firing position.

A still further object of this invention is to provide a receiver assembly for firearms which is simple in construction, economical to manufacture, and rugged and reliable in use.

Other objects of the invention will become apparent from time to time throughout the specification and claims as hereinafter related.

The above noted objects and other objects of the invention are accomplished by a receiver assembly for a firearm which slidably and rotatably carries a bolt having a non-rotating cartridge extractor-guide at the forward end that allows the bolt to rotate relative thereto and the bolt head has locking lugs which engage a locking surface in the forward or barrel end of the receiver when the bolt is in the firing position. A flexible feeding ramp in the firing chamber surrounds the extractor and serves as a cartridge guide and preloads the bolt axially in the firing position. A firing pin carrier assembly provides axial center line absorption of the firing mechanism forces while providing an off center firing pin tip required for rimfire ammunition. During the initial firing sequence the feeding ramp absorbs vibrations caused by the moving components of the firing mechanisms and the impact of the firing pin and the subsequent shock of ignition, and bullet movement. During the latter stages of the firing sequence the firing pin carrier assembly absorbs the shock of the firing pin cocking rod and sear assemblies thus reducing after shock vibration and contributing to firearm accuracy.

BRIEF DESCRIPTION OF THE DRAWINGS

FIG. 1 is an isometric, exploded view of the bolt, cartridge extractor-guide, and flexible feeding ramp in accordance with the present invention, shown in the unassembled condition.

FIG. 2 is an isometric, exploded view of the bolt, cartridge extractor-guide, and flexible feeding ramp of the present invention, with the cartridge extractor-guide installed on the bolt.

FIG. 3 is a longitudinal cross section through the flexible feeding ramp member.

FIG. 4 is a front view of the cartridge extractor-fguide.

FIG. 5 is a longitudinal cross section of the cartridge extractor-guide taken along line 5—5 of FIG. 4.

FIG. 6 is a longitudinal cross section of the cartridge extractor-guide taken along line 6—6 of FIG. 4.

FIG. 7 is a side elevation in partial cross section of the bolt, cartridge extractor-guide, and flexible feeding ramp installed in the receiver of the present invention, with the bolt in the cartridge loading position.

DESCRIPTION OF THE PREFERRED EMBODIMENT

Figure 8:
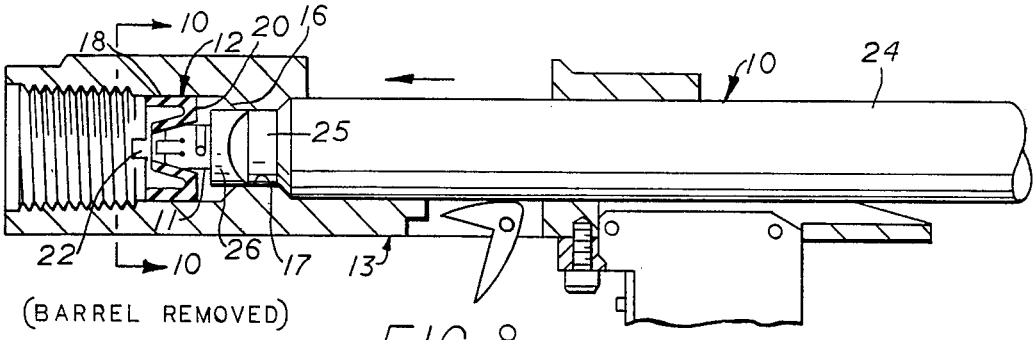
FIG. 8 is a side elevation in partial cross section of the bolt, cartridge extractor-guide, and flexible feeding ramp installed in the receiver of the present invention, with the bolt partially in the firing position.

While the preferred embodiment of the present invention is illustrated in relation to a bolt action rifle it should be understood that the present invention may be applied to any type of rimfire firearm. Referring to the drawings by numerals of reference, there is shown in FIGS. 1 and 2, a preferred bolt 10, cartridge extractor-guide 11, and flexible feeding ramp member 12 prior to being assembled in the receiver member of a firearm as described hereinafter.

As shown in FIGS. 7–11, the firearm receiver 13 comprises an elongated chamber 14 having interior threads at the forward end which threadedly receive a rifle barrel 15. A pair of opposed lugs 16 in the chamber 14 extend radially inward near the threaded end of the receiver 13 to form a generally oval or elliptical opening 17. The elliptical opening will engage corresponding locking lugs on the bolt as explained hereinafter.

Flexible feeding ramp 12 comprises a generally cylindrical member formed of flexible material such as nylon, polyurethane rubber, or other suitable materials. As best seen in FIGS. 2 and 3, flexible feeding ramp 12 has a cylindrical outer wall 18 open at one end and having an opposed end formed into an inwardly extending conical configuration 19 with a central opening 21 and an annular flat end face 20. A pair of diametrically opposed locating tabs 22 extend from the open end of feeding ramp 12. Feeding ramp 12 is installed in the forward end of receiver 13 such that locating tabs 22 are received into relief cuts 23 in the end of rifle barrel 15 (FIG. 12) which normally receive a conventional extractor and cartridge guide members.

When assembled, flexible feeding ramp 12 remains in the receiver firing chamber forward of receiver locking lugs 16 and engaged on barrel relief cuts 23 to provide a 360° feeding ramp and to form a cavity for the locking lugs of bolt 10 when the bolt is rotated into the firing position. As explained hereinafter, during the firing sequence the flexible feeding ramp is compressed and the resilient material absorbs vibrations between the fixed barrel and the movable bolt components.

Bolt 10 is an elongated cylindrical member which is slidably received in the generally cylindrical chamber 14 of receiver 13. Bolt 10 includes a cylindrical body 24 with a narrowed cylindrical portion 25 near the front or cartridge receiving end. A generally oval or elliptical front head portion 26 forms diametrically opposed locking lugs 27. A relatively small cylindrical extension 28 extends forwardly from the head portion to receive tubular cartridge extractor-guide 11. The manipulation of bolt 10 is accomplished by the bolt handle 29 at the rear portion of the bolt. Bolt 10 slides longitudinally with respect to receiver 13 between an open position (FIG. 7), wherein a cartridge may be inserted into the receiver, and a closed position (FIG. 9) wherein the bolt forces the cartridge into the firing chamber.

The front locking lugs for locking the bolt 10 in the firing position are integral with the bolt. The bolt handle is made integral with the bolt and is oriented in a plane normal to the longitudinal axis of bolt 10 and receiver 13. In locking bolt 10 relative to receiver 13, the bolt slides longitudinally so that locking lug surfaces 27 on the bolt and opening 17 of the receiver are generally in the same plane at which time the bolt is rotated to bring the locking lug surfaces 27 into engagement on the lugs 16 of the receiver opening 17.

In order to lock the bolt in the closed position, receiver 13 has a conventional annular looking lug slot or recess extending partially around the periphery of the rear portion of the receiver to accommodate the handle when the bolt is in the closed position. The peripheral rear slot or recess allows bolt 10 to be rotated through a given angle to move the forward locking lugs 27 out of alignment with locking lugs 16 in the receiver chamber. Since the rear bolt handle and peripheral slot or recess are conventional in nature, they are not shown in the drawings.

Flexible feeding ramp 12 is compressed when bolt 10 is rotated to the firing position (FIG. 9) and absorbs the vibration caused by the manufacturing clearances and tolerances of the moving parts, and the distance between the front and rear locking lug members of the bolt when the cartridge is fired.

As shown in FIGS. 4, 5, and 6, cartridge extractor-guide 11 comprises a thin hollow tubular member having a circumferential slot 29 extending through its side wall substantially 90° around its periphery. Extractor-guide 11 is slidably received on bolt extension 28 and rotatably maintained thereon by a retaining pin 30 secured to extension 28 through slot 29. The length of slot 29 allows bolt 10 to rotate approximately relative to non-rotating extractor-guide 11.

The front end of cartridge extractor-guide 11 has diametrically opposed longitudinal cuts through its side wall to form a pair of opposed clips 31 extending forward beyond the open front end of the cartridge extractor-guide. Clips 31 are bent sharply inward near the front surface of extractor-guide 11 and then diverge angularly outward in opposed relation. A preferred extractor-guide 11 is formed by stamping from spring steel.

Figure 12:
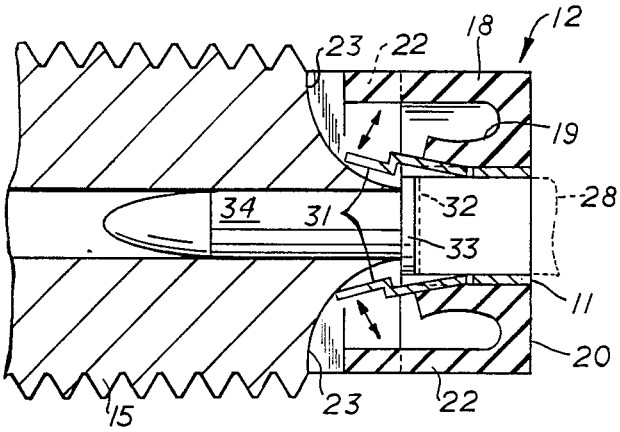
FIG. 12 is a top plan in cross section of the barrel with the extractor and cartridge guide cammed out of engagement with the cartridge.

When properly secured on bolt extension 28, the open front end surface of cartridge extractor-guide 11 extends just beyond the front surface of extension 28 to form a shallow recess 32 which receives the rim 33 of the cartridge 34 (FIG. 12). Clips 31 grip the underside of cartridge rim 33 to carry cartridge 34 with bolt 10. When bolt 10 moves to the forward position, the clips are slidably received the corresponding relief cuts 23 in the face of barrel 15. When bolt 10 is rotated into the firing position (FIG. 9), the cartridge extractor-guide 11 is held in non-rotation position by the engagement of clips 31 in relief cuts 23.

The diverging ends of clips 31 of extractor-guide 11 expand and then contract as they fit over the rim of the cartridge when the bolt is moved forward serving as a guide and the radially inward bent portions insure contact of the cartridge with the extractor-guide. After firing, extraction of the cartridge case is accomplished by the radially inward bent portion of extractor clips 31 of non-rotating extractor-guide 11 engaged beneath the cartridge rim as the bolt is retracted.

Figure 9:
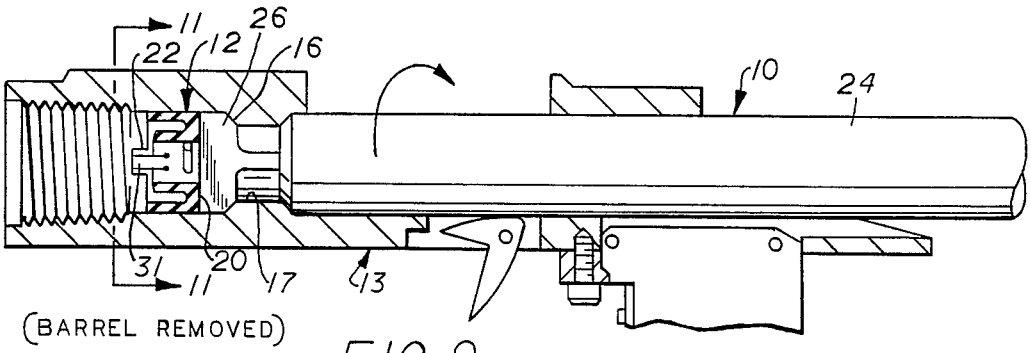
FIG. 9 is a side elevation in partial cross section of the bolt, cartridge extractor-guide, and flexible feeding ramp installed in the receiver of the present invention, with the bolt in the firing position.
Figure 10:
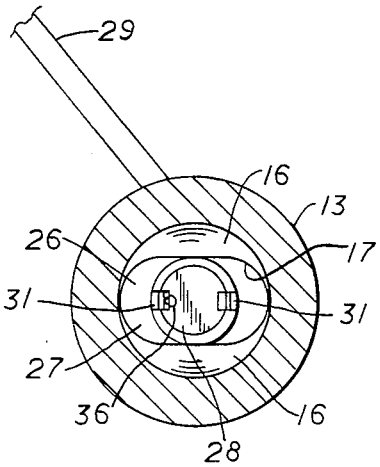
FIG. 10 is a transverse cross section of the receiver 20 and front end of the bolt taken along line 10—10 of FIG. 8 with the feeding ramp removed showing the firing pin and extractor and cartridge guide at the 9 o'clock position.
Figure 11:
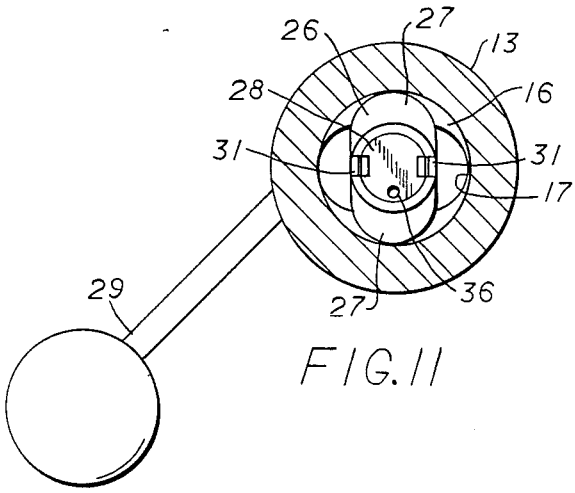
FIG. 11 is a transverse cross section of the receiver and front end of the bolt taken along line 11—11 of FIG. 9 with the feeding ramp removed showing the extractor and cartridge guide at the 9 o'clock position, and the firing pin at the 6 o'clock position.

As best seen in FIGS. 10 and 11, oval or elliptical opening 17 and lugs 16 at the front of receiver recess 14 allow elliptical front head 26 of bolt 10 to pass therethrough and be rotated to the firing position as shown in FIG. 9. Bolt head 26 passes through opening 17 and is rotated to engage lugs 16 and compress flexible feeding ramp 12. Bolt head 26 together with bore 35 in barrel 15, flexible feeding ramp 12, and cooperating lugs 16 of the receiver, forms the locked breach of the firearm.

Figure 13:
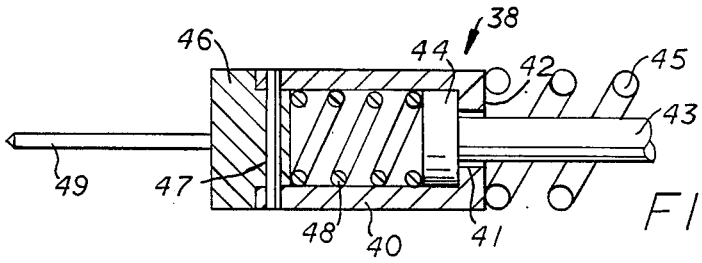
FIG. 13 is a longitudinal cross section from one side of the firing pin carrier with the firing pin at the 9 o'clock position.
Figure 14:
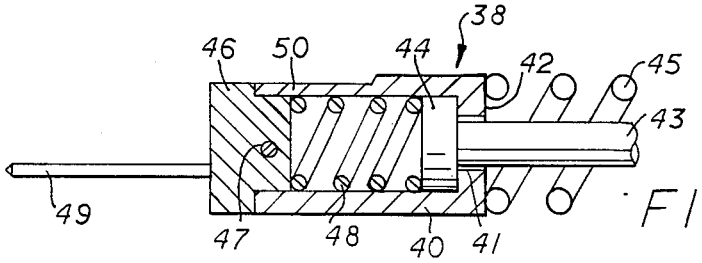
FIG. 14 is a longitudinal cross section from one side of the firing pin carrier with the firing pin at the 6 o'clock position.
Figure 15:
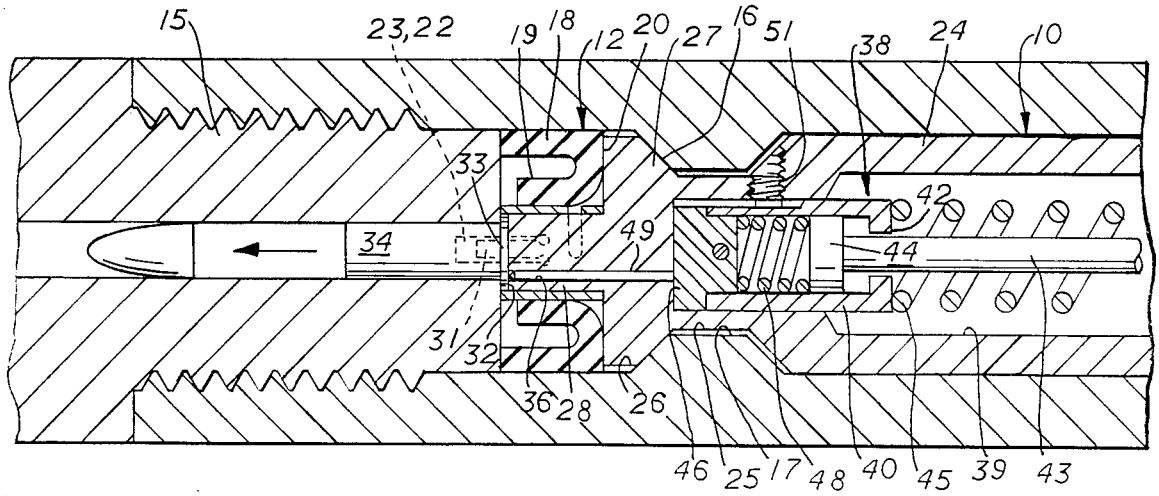
FIG. 15 is a side elevation in cross section of the bolt, cartridge extractor-guide, flexible feeding ramp, and firing pin carrier installed in the receiver of the present invention, with the bolt in the fired position.

As best seen in FIGS. 10, 11, and 15, cylindrical extension 28 of bolt head 26 has an off-center bore 36 for the passage of firing pin 37. The off-center firing pin assembly 38 (FIGS. 13 and 14) is contained in an axial bore 39 in bolt 10 as shown in FIG. 15. The firing pin assembly 38 comprises a tubular carrier housing 40 open at the forward end and having a hole 41 through the wall 42 at the back end. A cocking rod 43 extends slidably through the hole 41 and the flanged head portion 44 of the cocking rod is slidably received in the housing 40. The main spring 45 surrounds cocking rod 43 and is biased between housing end wall 42 and the sear (not shown). The sear, and the cocking and firing mechanisms are standard for center fire firearms and as such are not illustrated herein.

An end cap 46 is secured in the open end of housing 40 by a cross pin 47 extending through the cap and the housing side wall. A compression spring 48 is biased within housing 40 between cap 46 and flanged head 44. Firing pin 49 is secured to cap 46 and extends forwardly therefrom parallel to and eccentrically offset from the longitudinal axis. The spring loaded firing pin carrier assembly 38 with the eccentric or off-center firing pin compensates for the force of the firing pin fall and dampens the post ignition vibration caused by the moving parts of the firing pin assembly. Spring 48 both determines the amount of force contributed by the weight of the moving cocking rod and sear to the firing pin fall and the amount of after shock or post ignition vibration that is experienced.

Housing 40 has a longitudinal flat 50 milled on one side and firing pin assembly 38 is secured within bore 39 in bolt 10 by a set screw 51. The firing pin assembly is secured on the center line of bolt 10 and receiver 13 and is free to rotate With the bolt about the axis of longitudinally movable cocking rod 43. Thus, it can be seen that main spring 45 and resultant forces and vibrations experienced during the firing sequence is largely centered on the center line of the firearm, resulting in a more accurate firearm.

OPERATION

In operation, bolt 10 is retracted and the cartridge is inserted into receiver chamber 14. As bolt 10 is moved forward, diverging ends of clips 31 of extractor-guide 11 expand outwardly and snap over rim 33 of the cartridge 34 to releasably capture the cartridge rim in recess 32 at the forward end of the bolt and extractor-guide. The cartridge is thus held firmly and guided into the firing chamber as the bolt moves forward. As the cartridge moves into the firing chamber, the cartridge and extractor-guide passes into conical portion 19 of flexible feeding ramp 12. Thus the flexible feeding ramp resiliently surrounds the extractor-guide to guide and properly position the cartridge.

As bolt 10 is rotated into the locked position, the cartridge is forced into bore 35 of barrel 15 secured in receiver 13. Locking lugs 27 of bolt head 26 are supported by the cooperating lugs 16 formed in the forward interior portion of the receiver, and extractor clips 31 are cammed out of engagement with the cartridge rim (FIG. 12) by relief cuts 23 in the end surface of barrel 15. When bolt 10 is rotated either into the locked or unlocked position, barrel relief cuts 23 keep extractor-guide 11 from rotating with the bolt while allowing the bolt to rotate within the extractor guide. Extractor-guide 11 is held captive on bolt extension 28 by pin 30 riding in slot 29. Clips 31 of extractor-guide 11 are forced against the curved surfaces of relief cuts 23 in the end of rifle barrel 15 and expand outwardly to release their grip on the cartridge rim.

When firing, the firing pin assembly moves from the cocked position under pressure from main spring 45 until the firing pin tip contacts and indents the rim of the cartridge. At this point the cocking rod and sear are free to continue their movement until the compression spring overcomes their momentum. This results in a dampening effect which reduces the after ignition shock and resulting vibrations.

During movement of the bolt to the unlocked and cartridge loading position (FIG. 7), extractor-guide 11 and clips 31 are under spring tension and ride down the curved surfaces of relief cuts 23 in barrel 15 and re-engage the underside of the cartridge rim. The cartridge is ejected from the receiver in a conventional manner common to both rimfire and centerfire firearms and as such is not described herein.

Thus, a rimfire action is provided by this invention in which a firearm can be produced that is stronger due to integral front locking lugs and provides increased accuracy through vibration dampening and more even distribution of the moving forces about the center line of the firearm. Additionally, more reliable feeding of the cartridge is provided by the flexible feeding ramp which pre-loads the bolt axially. During the initial firing sequence the feeding ramp absorbs vibrations caused by the moving components of the firing mechanisms and the impact of the firing pin and the subsequent shock of ignition, and bullet movement. Additionally during the latter stages of the firing sequence the firing pin carrier assembly absorbs the shock of the firing pin cocking rod and sear assemblies thus reducing after shock vibration and contributing to firearm accuracy. Additionally, the firing pin carrier assembly provides axial center line absorption of the firing mechanisms forces while providing an off center firing pin tip required for rimfire ammunition.

While this invention has been described fully and completely with special emphasis upon a preferred embodiment, it should be understood that within the scope of the appended claims the invention may be practiced otherwise than as specifically described herein. The preferred embodiment presents the invention as applied to rimfire applications. It should be noted that the invention may also be applied to centerfire firearms.

I claim:

1. A receiver assembly for a firearm having an elongated longitudinal chamber adapted to receive a cylindrical barrel within one end thereof comprising;

means forming a bolt engaging opening in the longitudinal chamber of the receiver spaced axially from the inward end of the barrel to form a cylindrical cavity therebetween, a bolt slidably and rotatably mounted in the longitudinal bore of the receiver and having a head portion at its front end adapted to be slidably received through said bolt engaging opening and engaged therewith upon rotation, and a non-rotating flexible cartridge feeding ramp installed in said cylindrical cavity between the inward end of the barrel and the bolt engaging opening and having a conical opening in axial alignment with the longitudinal bore of the barrel and the longitudinal axis of said bolt for guiding a live cartridge into the bore of the barrel.

2. A receiver assembly according to claim 1 in which said cartridge feeding ramp is compressed between the inward end of the barrel and the end of the bolt engaged in the bolt engaging opening of the receiver during the cartridge firing sequence to preload the bolt axially and absorb vibrations between the fixed barrel and the movable bolt components.

3. A receiver assembly according to claim 1 in which said bolt engaging opening defined by a pair of opposed lugs in the chamber extending radially inward near the threaded end of the receiver to form a generally elliptical opening, and said bolt head portion having radially outward extending lugs which correspond to the elliptical opening to be slidably received therethrough and engage the lugs of the opening upon rotation of said bolt.

4. A receiver assembly according to claim 1 in which said cartridge feeding ramp is compressed between the inward end of the barrel and the end of the bolt engaged in the bolt engaging opening of the receiver during the cartridge firing sequence to preload the bolt axially and absorb vibrations between the fixed barrel and the movable bolt components, said bolt engaging opening defined by a pair of opposed lugs in the chamber extending radially inward near the threaded end of the receiver to form a generally elliptical opening, and said bolt head portion having radially outward extending lugs which correspond to the elliptical opening to be slidably received therethrough and engage the lugs of the opening upon rotation of said bolt.

5. A receiver assembly according to claim 1 in which said non-rotating flexible cartridge feeding ramp comprises;

a generally cylindrical member formed of flexible material received in said cylindrical cavity between the inward end of said barrel and the bolt engaging opening and having a cylindrical side wall and front and back ends with a central conical opening extending inwardly from the back end receive a cartridge therethrough and barrel engaging means on the front end for engaging the inward end of the barrel to prevent rotation of said cylindrical member in said cavity relative to said receiver, said cylindrical member positioned with the smaller end of the conical opening adjacent the inward end of said barrel in axial alignment with the longitudinal barrel bore and the larger end of said conical opening adjacent the bolt engaging opening in said receiver and axially aligned with the longitudinal receiver chamber, whereby the conical opening provides a guide for feeding a cartridge into the bore of the barrel to be fired and said cylindrical member is compressed between the inward end of the barrel and the end of the bolt engaged in the receiver bolt engaging opening during the cartridge firing sequence to axially preload the bolt and absorb vibrations between the fixed barrel and the movable bolt components.

6. A receiver assembly according to claim-1 in which said cartridge feeding ramp is compressed between the inward end of the barrel and the end of the bolt engaged in the bolt engaging opening of the receiver during the cartridge firing sequence to preload the bolt axially and absorb vibrations between the fixed barrel and the movable bolt components, said cartridge feeding ramp comprising a generally cylindrical member formed of flexible material received in said cylindrical cavity between the inward end of said barrel and the bolt engaging opening and having a cylindrical side wall and front and back ends with a central conical opening extending inwardly from the back end receive a cartridge therethrough and barrel engaging means on the front end for engaging the inward end of the barrel to prevent rotation of said cylindrical member in said cavity relative to said receiver, said cylindrical member positioned with the smaller end of the conical opening adjacent the inward end of said barrel in axial alignment with the longitudinal barrel bore and the larger end of said conical opening adjacent the bolt engaging opening in said receiver and axially aligned with the longitudinal receiver chamber, whereby the conical opening provides a guide for feeding a cartridge into the bore of the barrel to be fired and said cylindrical member is compressed between the inward end of the barrel and the end of the bolt engaged in the receiver bolt engaging opening during the cartridge firing sequence to axially preload the bolt and absorb vibrations between the fixed barrel and the movable bolt components.

7. A receiver assembly according to claim 6 in which said barrel engaging means comprises a pair of diametrically opposed generally rectangular tabs extending from the open end to be received into relief cuts provided in the inward end surface of the barrel.

8. A receiver assembly according to claim 1 including a tubular cartridge extractor-guide rotatably mounted on the forward end of said bolt to allow said bolt to rotate approximately 90° relative thereto and having cartridge receiving and gripping means on the front end thereof for receiving and releasably retaining the rim of a cartridge on the front end of said bolt during movement to a firing position, said receiving and gripping means engaging the inward end of said barrel upon sufficient forward movement of said bolt to release said cartridge and thereafter prevented by the engagement from rotating with said bolt during rotation to a firing position, and said receiving and gripping means receiving and releasably retaining the rim of the cartridge case after the cartridge is fired and said bolt is retracted to extract the casing from the firing chamber.

9. A receiver assembly according to claim 8 in which said bolt has a reduced diameter cylindrical extension at its front end, and said extractor-guide member comprises a hollow tubular member having a circumferential slot extending through its side wall substantially 90° around its periphery, said extractor-guide slidably received on said bolt extension and rotatably maintained thereon by a retaining pin secured to said extension through said slot.

10. A receiver assembly according to claim 9 in which the forward end of said tubular member extends beyond the front end surface of said extension to form a shallow recess which slidably receives the rim of the cartridge, and said receiving an gripping means comprises a pair of opposed clips which extend forward beyond the front end of said tubular member and are bent sharply inward near the front surface of the tubular member and then diverge angularly outward in opposed relation, the diverging ends of said clips expanding and contracting laterally as they receive the rim of the cartridge when said bolt is moved forward and the inwardly bent portions releasably maintaining the cartridge rim within said recess in contact with the front end of said bolt, and after firing, the bent portions extracting the cartridge case as said bolt is retracted.

11. A receiver assembly according to claim 10 in which said clips are slidably received in relief cuts in the inward end surface of the barrel such that they expand outwardly when received therein and remain engaged therein when said bolt is rotated into the firing position whereby said cartridge extractor-guide is held in non-rotation position relative to said bolt.

12. A receiver assembly according to claim 1 including a firing pin carrier resiliently connected at the forward end of a cocking rod which is connected to a sear assembly at its rearward end, said firing pin carrier secured concentrically within said bolt to rotate therewith and having a firing pin extending forwardly therefrom parallel and eccentrically offset from the longitudinal axis of said housing, said firing pin slidably received in a bore through the front portion of said bolt eccentrically offset from the longitudinal axis of bolt and extensible beyond the front end surface of said bolt to compress the rim of the cartridge, and said firing pin carrier and cocking rod resiliently connected such that shock forces of the cocking rod and sear assembly are absorbed through the connection during the latter stages of the firing sequence to reduce after shock vibration.

13. A receiver assembly according to claim 12 in which said firing pin carrier comprises a tubular housing open at its front end and having a back wall and a central hole through the back wall, said cocking rod extending slidably through said hole and having a flanged head portion slidably received within said housing, an end cap secured in the open end of said housing, said firing pin secured to said end cap and extending forwardly therefrom parallel and eccentrically offset from the longitudinal axis of said housing, a compression spring within the housing biased between said end cap and the flanged head of said cocking rod, and a main spring surrounding the cocking rod and biased between said housing back wall and the sear assembly.

14. A receiver assembly according to claim 1 including a firing pin carrier secured concentrically within said bolt to rotate therewith and having a firing pin extending forwardly therefrom parallel and eccentrically offset from the longitudinal axis of said housing, said firing pin carrier adapted to be resiliently connected at the forward end of a cocking rod, said firing pin being slidably received in a bore through the front portion of said bolt eccentrically offset from the longitudinal axis of bolt and extensible beyond the front end surface of said bolt to compress the rim of the cartridge, and said firing pin carrier and cocking rod adapted to be resiliently connected such that shock forces of the cocking rod and sear assembly are absorbed through the connection during the latter stages of the firing sequence to reduce after shock vibration.

15. A receiver assembly according to claim 14 in which said firing pin carrier comprises a tubular housing open at its front end and having a back wall and a central hole through the back wall, said cocking rod extending slidably through said hole and having a flanged head portion slidably received within said housing, an end cap secured in the open end of said housing, said firing pin secured to said end cap and extending forwardly therethrough parallel and eccentrically offset from the longitudinal axis of said housing, a compression spring within the housing biased between said end cap and the flanged head of said cocking rod, and a main spring surrounding the cocking rod and biased between said housing back wall and the sear assembly.

16. A receiver assembly for a rimfire firearm having an elongated longitudinal chamber adapted to receive a cylindrical barrel within one end thereof comprising;

means forming a bolt engaging opening in the longitudinal chamber of the receiver spaced axially from the inward end of the barrel to form a cylindrical cavity therebetween, a bolt slidably and rotatably mounted in the longitudinal bore of the receiver and having a generally elliptical head portion at the front of said bolt which forms diametrically opposed locking lugs to be slidably received through the bolt engaging opening and engaged therewith upon rotation, a tubular cartridge extractor-guide rotatably mounted on the forward end of said bolt to allow said bolt to rotate approximately 90° relative thereto, cartridge receiving and gripping means on the front end of said extractor-guide which receive and releasably retain the rim of a cartridge on the front end of said bolt while being carried to a firing position, said receiving and gripping means engaging the inward end of said barrel upon sufficient forward movement of said bolt to release said cartridge and thereafter prevented by the engagement from rotating with said bolt as it is rotated to a firing position in the bolt retaining opening of the receiver, and said receiving and gripping means receiving and releasably retaining the rim of said cartridge case after firing and said bolt is being retracted from the forward position to extract the casing from the firing chamber.

17. A receiver assembly according to claim 16 in which said bolt has a reduced diameter cylindrical extension at its front end, and said extractor-guide member comprises a hollow tubular member having a circumferential slot extending through its side wall substantially 90° around its periphery, said extractor-guide slidably received on said bolt extension and rotatably maintained thereon by a retaining pin secured to said extension through said slot.

18. A receiver assembly according to claim 17 in which the forward end of said tubular member extends beyond the front end surface of said extension to form a shallow recess which slidably receives the rim of the cartridge, and said receiving an gripping means comprises a pair of opposed clips which extend forward beyond the front end of said tubular member and are bent sharply inward near the front surface of the tubular member and then diverge angularly outward in opposed relation, the diverging ends of said clips expanding and contracting laterally as they receive the rim of the cartridge when said bolt is moved forward and the inwardly bent portions releasably maintaining the cartridge rim within said recess in contact with the front end of said bolt, and after firing, the bent portions extracting the cartridge case as said bolt is retracted.

19. A receiver assembly according to claim 18 in which said clips are slidably received in corresponding relief cuts formed in the inward end surface of the barrel such that they expand outwardly when received therein and remain engaged therein when said bolt is rotated into the firing position whereby said cartridge extractor-guide is held in non-rotation position relative to said bolt.

20. A receiver assembly according to claim 16 in which a firing pin carrier secured concentrically within said bolt to rotate therewith and having a firing pin extending forwardly therefrom parallel and eccentrically offset from the longitudinal axis of said housing, said firing pin carrier adapted to be resiliently connected at the forward end of a cocking rod which is connected to a sear assembly at its rearward end, said firing pin slidably received in a bore through the front portion of said bolt eccentrically offset from the longitudinal axis of bolt and extensible beyond the front end surface of said bolt to pierce the rim of the cartridge, and said firing pin carrier and cocking rod adapted to be resiliently connected such that shock forces of the cocking rod and sear assembly are absorbed through the connection during the latter stages of the firing sequence to reduce after shock vibration.

21. A receiver assembly according to claim 20 in which said firing pin carrier comprises a tubular housing open at its front end and having a back wall and a central hole through the back wall, said cocking rod extending slidably through said hole and having a flanged head portion slidably received within said housing, an end cap secured in the open end of said housing, said firing pin secured to said end cap and extending forwardly therefrom parallel and eccentrically offset from the longitudinal axis of said housing, a compression spring within the housing biased between said end cap and the flanged head of said cocking rod, and a main spring surrounding the cocking rod and biased between said housing back wall and the sear assembly.

22. A receiver assembly according to claim 16 in which a handle secured to the rear portion of said cylindrical body for sliding and rotating the bolt relative to the receiver chamber between an open position wherein a cartridge may be inserted into the receiver, and a closed firing position wherein the bolt forces the cartridge into a firing chamber of the receiver.

23. A sliding and rotating bolt for a rimfire firearm having a receiver assembly having an elongated cylindrical chamber and a rifle barrel secured in the forward end thereof, said bolt comprising an elongate cylindrical body adapted to be slidably and rotatably mounted within said elongated chamber having a bolt engaging opening spaced axially from the inward end of the firearm barrel, a generally elliptical head portion forward of said cylindrical body forming diametrically opposed locking lugs slidably received through the bolt engaging opening when assembled and engaged therewith upon rotation, and a tubular cartridge extractor-guide rotatably mounted on the forward end of said bolt to allow rotation approximately 90° relative thereto, cartridge receiving and gripping means on the forward end of said extractor-guide to receive and releasably retain the rim of a cartridge on the front end of said bolt while being carried by said bolt to a firing position, said receiving and gripping means engaging the inward end of said barrel upon sufficient forward movement of said bolt to release said cartridge and thereafter prevented by the engagement from rotating with said bolt as it is rotated to a firing position in the bolt retaining opening of the receiver, and said receiving and gripping means receiving and releasably retaining the rim of said cartridge case after the cartridge has been fired and said bolt is being retracted from the forward position to extract the casing from the firing chamber.

24. A bolt according to claim 23 in which said bolt has a reduced diameter cylindrical extension at its front end, and said extractor-guide member comprises a hollow tubular member having a circumferential slot extending through its side wall substantially 90° around its periphery, said extractor-guide being slidably received on said bolt extension and rotatably maintained thereon by a retaining pin secured to said extension through said slot.

25. A bolt according to claim 24 in which the forward end of said tubular member extends beyond the front end surface of said extension to form a shallow recess receiving the rim of said cartridge, and said receiving and gripping means comprising a pair of opposed clips extending forward of said tubular member and bent sharply inward near the front surface of said tubular member and then diverge angularly outward in opposed relation, the diverging ends of said clips expanding and contracting laterally as they receive the rim of the cartridge when said bolt is moved forward and the inwardly bent portions releasably maintaining the cartridge rim within said recess in contact with the front end of said bolt, and after firing, the bent portions extracting the cartridge case as said bolt is retracted.

26. A bolt according to claim 25 in which said clips are slidably received in corresponding relief cuts in the inward end surface of said barrel such that they expand outwardly when received therein and remain engaged therein when said bolt is rotated into the firing position whereby said cartridge extractor-guide is held in non-rotation position relative to said bolt.

27. A bolt according to claim 23 including a firing pin carrier secured concentrically within said bolt to rotate therewith and having a firing pin extending forwardly therefrom parallel and eccentrically offset from the longitudinal axis of said housing, said firing pin carrier adapted to be resiliently connected at the forward end of a cocking rod which is connected to a sear assembly at its rearward end, said firing pin slidably received in a bore through the front portion of said bolt eccentrically offset from the longitudinal axis of bolt and extensible beyond the front end surface of said bolt to pierce the rim of the cartridge, and said firing pin carrier and cocking rod adapted to be resiliently connected such that shock forces of the cocking rod and sear assembly are absorbed through the connection during the latter stages of the firing sequence to reduce after shock vibration.

28. A bolt according to claim 27 in which said firing pin carrier comprises a tubular housing open at its front end and having a back wall and a central hole through the back wall, said cocking rod extending slidably through said hole and having a flanged head portion slidably received therein, an end cap secured in the open end of said housing, said firing pin secured to said end cap and extending forwardly in parallel and eccentrically offset relation, a compression spring within the housing biased between said end cap and the flanged head of said cocking rod, and a main spring surrounding the cocking rod and biased between said housing back wall and the sear assembly.

29. A bolt according to claim 23 including a handle secured to the rear portion of said cylindrical body for sliding and rotating the bolt relative to the receiver chamber between an open position wherein a cartridge may be inserted into the receiver, and a closed firing position wherein the bolt forces the cartridge into a firing chamber of the receiver.

30. A non-rotating flexible cartridge feeding ramp for installation in a firearm receiver having an elongated longitudinal chamber in which a bolt is slidably and rotatably mounted and which receives a cylindrical-barrel within one end thereof and which has a bolt engaging opening in the chamber spaced axially from the inward end of the barrel to form a cylindrical cavity therebetween, said cartridge feeding ramp comprising;

a generally cylindrical member of flexible material adapted to be received in the cylindrical cavity formed between the inward end of said barrel and bolt engaging opening and having a cylindrical side wall and opposed front and back ends with a central conical opening extending inwardly from the back end adapted to receive a cartridge therethrough and having barrel engaging means on the front end for engaging the inward end of the barrel to prevent rotation of said cylindrical member in said cavity relative to said receiver, whereby said conical opening provides a guide for feeding a cartridge into the bore of the barrel when installed thereon and compressed between the inward end of the barrel and the end of the bolt engaged in the receiver bolt engaging opening during the cartridge firing sequence to axially preload the bolt and absorb vibrations between the fixed barrel and the movable bolt components.

31. A cartridge feeding ramp according to claim 30 in which said barrel engaging means comprises a pair of diametrically opposed generally rectangular tabs extending from the open end of said cylindrical member and adapted to be received into relief cuts provided in the inward end surface of the barrel.

* * * * *